United States Patent [19]

Harbeck et al.

[11] 4,334,336

[45] Jun. 15, 1982

[54] SURFACE CLEANING VACUUM NOZZLE

[75] Inventors: Martin E. Harbeck; Henry C. Harbin, both of Anderson, S.C.

[73] Assignee: The Singer Company, Stamford, Conn.

[21] Appl. No.: 145,645

[22] Filed: May 2, 1980

[51] Int. Cl.[3] ..... A47L 9/02

[52] U.S. Cl. ..... 15/322

[58] Field of Search ..... 15/321, 322, 410

[56] References Cited

U.S. PATENT DOCUMENTS 3,896,521 7/1975 Parise ..... 15/321
4,075,733 2/1978 Parise et al. ..... 15/322
4,083,077 4/1978 Knight et al. ..... 15/322 X
4,123,818 11/1978 Hurwirtz ..... 15/321

*Primary Examiner*—Chris K. Moore
*Attorney, Agent, or Firm*—James M. Trygg; Robert E. Smith; Edward L. Bell

[57] ABSTRACT

A surface cleaning vacuum nozzle having a cleaning materials dispenser slidingly attached thereto, the entire assembly being connectable to a hand held suction wand having a valve attached thereto which is in fluid communication with a cleaning fluid supply. The sliding action of the dispenser aids in the connecting or disconnecting of the nozzle.

10 Claims, 6 Drawing Figures

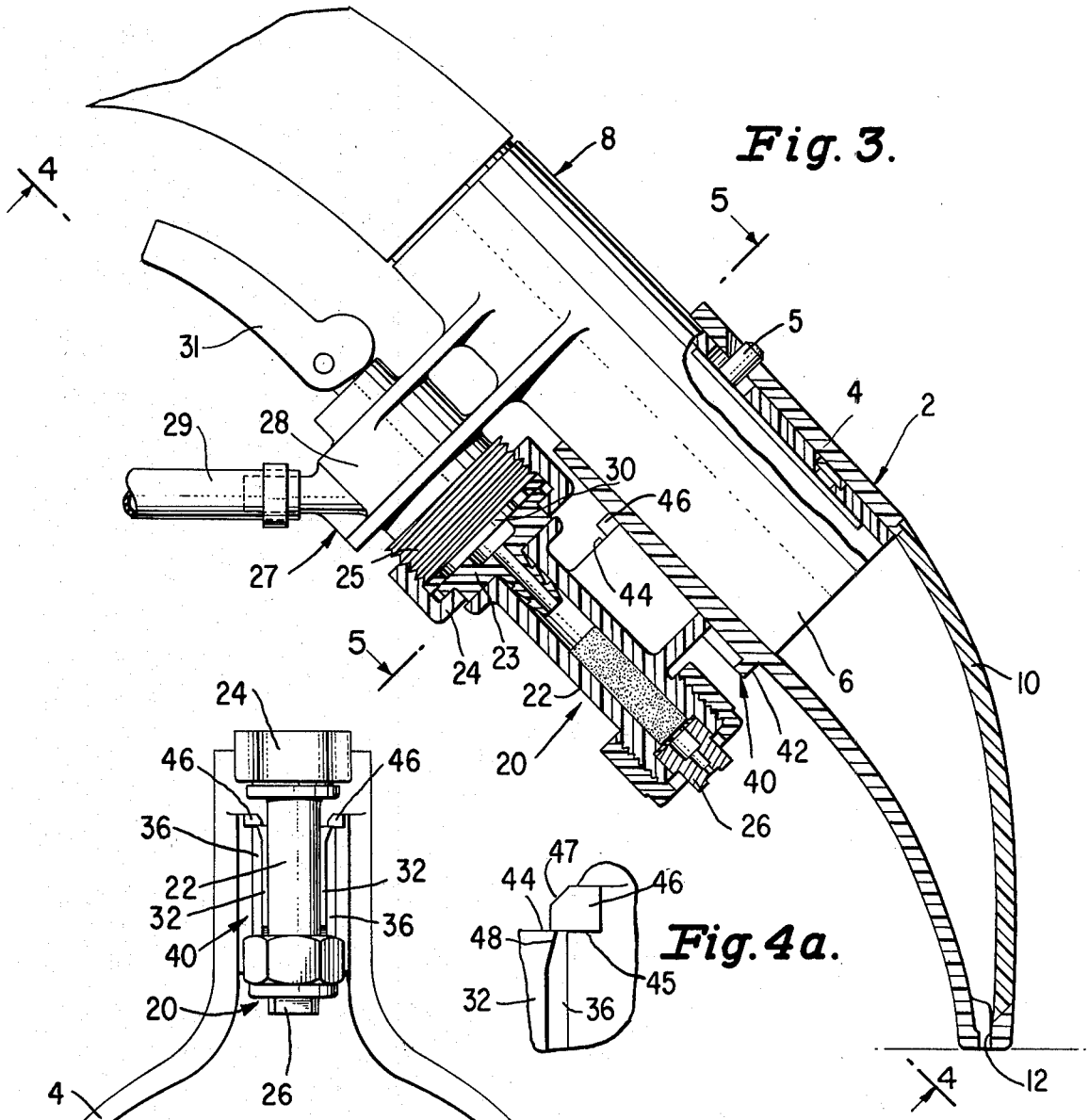
Fig. 3.
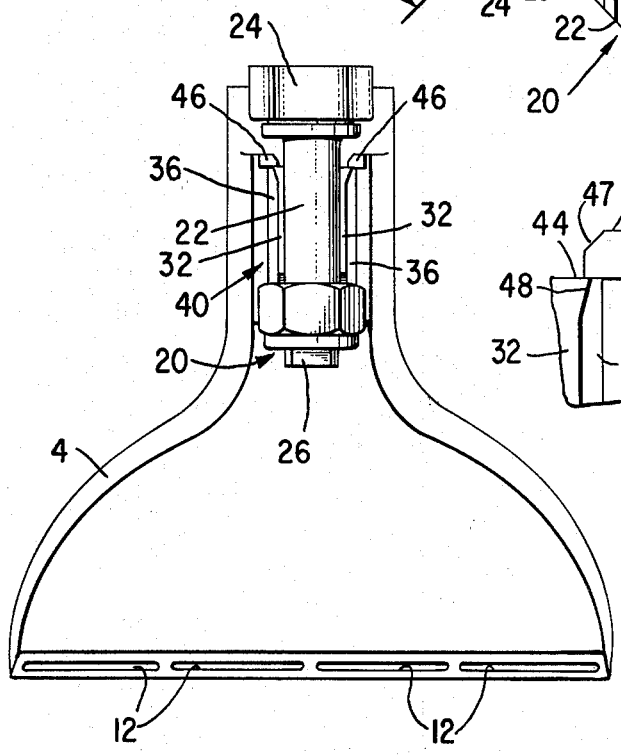
Fig. 4.
Fig. 4a.
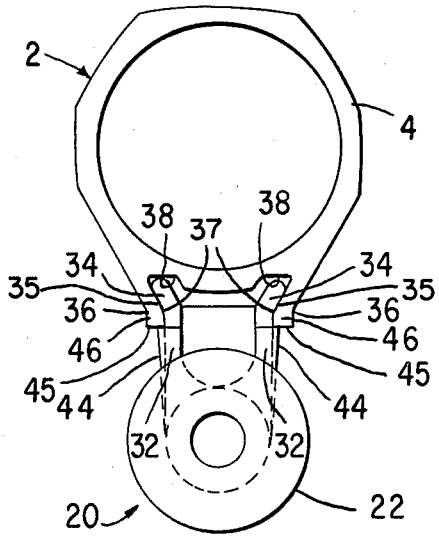
Fig. 5.

SURFACE CLEANING VACUUM NOZZLE

BACKGROUND OF THE INVENTION

This invention pertains to surface cleaning vacuum nozzles of the type having a dispenser attached thereto for dispensing hot water, cleaning fluids, powders, or the like and are adapted to operate in conjunction with hot water extraction carpet cleaning systems. It is desirable that such nozzles can be quickly, easily and conveniently removed from and reassembled to a hand held wand which is in vacuum communication with a suction source. In such an arrangement the same wand may then be used with a variety of nozzles and other tools for upholstery and other fabric cleaning tasks.

When assembling such a nozzle to the wand, two fluid connections must be made; the first being the body of the nozzle to the vacuum port of the wand, and the second being the dispenser to the cleaning fluid supply conduit. Generally, the fluid supply conduit is rigidly attached to the wand, and the dispenser rigidly attached to the nozzle body, wherein the fluid connection is made by use of two matting threaded portions having a resilient seal disposed therebetween. The suction connection is merely a slip fit coupling between the inside diameter of the suction part of the nozzle body and the outside diameter of the suction part of the wand. A spring loaded detent holds the two parts in operational engagement.

Inherent in the arrangement described above is the difficulty encountered when attempting to assemble the nozzle to the wand. Of the suction and fluid connections, one cannot be completely connected until the other is at least partially connected. This is the case because the mating elements for the two connections are rigidly attached to the two parts being connected and each connection requires a substantial amount of lead-in from the point where the connection is first begun to where the connection is complete. Thus, the traverse of the lead-in for each connection must necessarily be done, more or less, simultaneously in order to assemble the two parts without binding one of the two connections. A similar problem exists when attempting to disconnect the nozzle from the wand.

Typical surface cleaning vacuum devices are constructed as special purpose devices in that the nozzle portion is not intended to be easily disconnected from the wand for replacement by other attachments. See, for example, U.S. Pat. No.: 3,883,301, May 13, 1975, Emrick et al; U.S. Pat. No. 3,909,197, Sept. 30, 1975, Cremers; U.S. Pat. No. 3,942,217, Mar. 9, 1976, Bates; U.S. Pat. No. 4,158,575, June 19, 1979, Townsend; and U.S. Pat. No. 4,127,913, Dec. 5, 1978, Monson, all of which disclose relatively long hand held wands having nozzles and cleaning fluid dispensers that are not easily detached from the wand. Other surface cleaning vacuum devices such as U.S. Pat. No. 4,074,387, Feb. 21, 1978, Arato et al. and U.S. Pat. No. 4,159,554, July 3, 1979, Knight et al. utilize a relatively short handle portion integrally molded to a nozzle. The free end of the handle portion is fitted to a flexible conduit for supplying suction. Heretofore, there has been no entirely satisfactory provision for the quick and convenient removal and reattachment of an upholstery cleaning vacuum nozzle or other similar tools to the wand.

SUMMARY OF THE INVENTION

The present invention overcomes these difficulties of the prior art by providing a novel upholstery cleaning nozzle having a capability for permitting the quick and convenient coupling and decoupling of a cleaning vacuum nozzle or the like from a hand held wand having a suction connection and a cleaning fluid connection.

It is therefor an object of this invention to provide a means for easily and quickly coupling the suction connection independent of the cleaning fluid connection.

It is another object of this invention to provide a coupling means for the cleaning fluid dispenser so that the dispenser may be coupled to the cleaning fluid connection of the wand after the suction connection is made.

It is another object of this invention to provide a mounting means for the cleaning fluid dispenser so that the dispenser is held captive to the cleaning vacuum nozzle.

Other objects and advantages of the invention will become apparent through reference to the accompanying drawings and descriptive matter which illustrate a preferred embodiment of this invention.

According to the present invention, there is provided a surface cleaning vacuum nozzle, or the like, having a body of hollow interior adapted for connection to a vacuum source. The body contains an orifice which is in vacuum communication with the interior for engaging the surface and removing loose dirt or the like therefrom. A cleaning materials dispenser is slidingly attached to the body and has a cleaning fluid connector which is adapted to be connected to a cleaning materials supply for applying the cleaning material to the surface in close proximity to the orifice.

BRIEF DESCRIPTION OF THE DRAWINGS

In order that the invention be more fully understood, it will be described by way of example with reference to the accompanying drawings in which:

FIG. 3 is a side view taken in section;

FIG. 4 is a view taken along lines 4—4, FIG. 3;

FIG. 4*a* is a detailed view of a portion of FIG. 4; and,

FIG. 5 is a view taken along lines 5—5, FIG. 3.

DESCRIPTION OF THE PREFERRED EMBODIMENT

Figure 1:
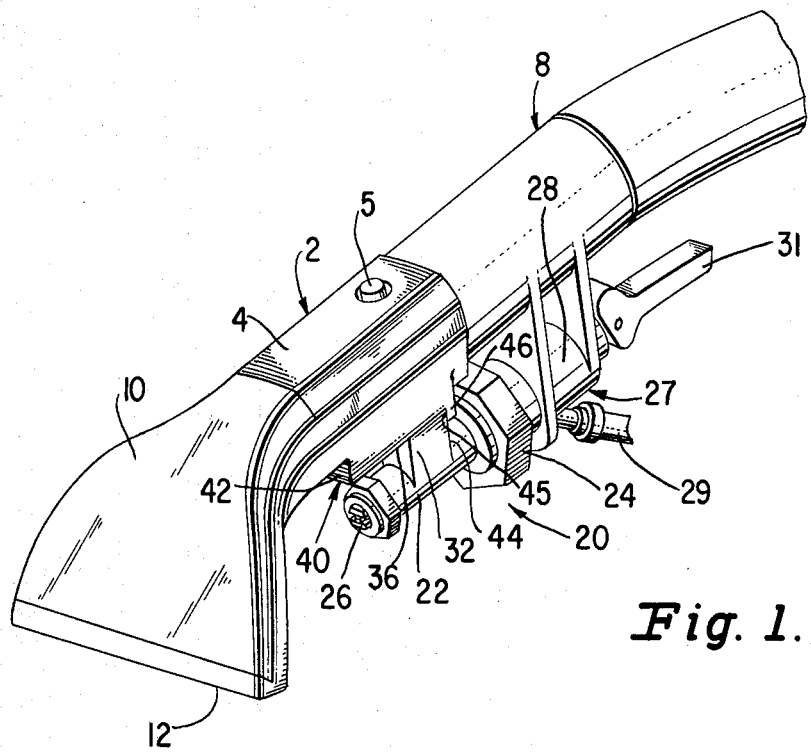
FIG. 1 is a perspective view of a surface cleaning vacuum nozzle having the present invention incorporated therein.
Figure 2:
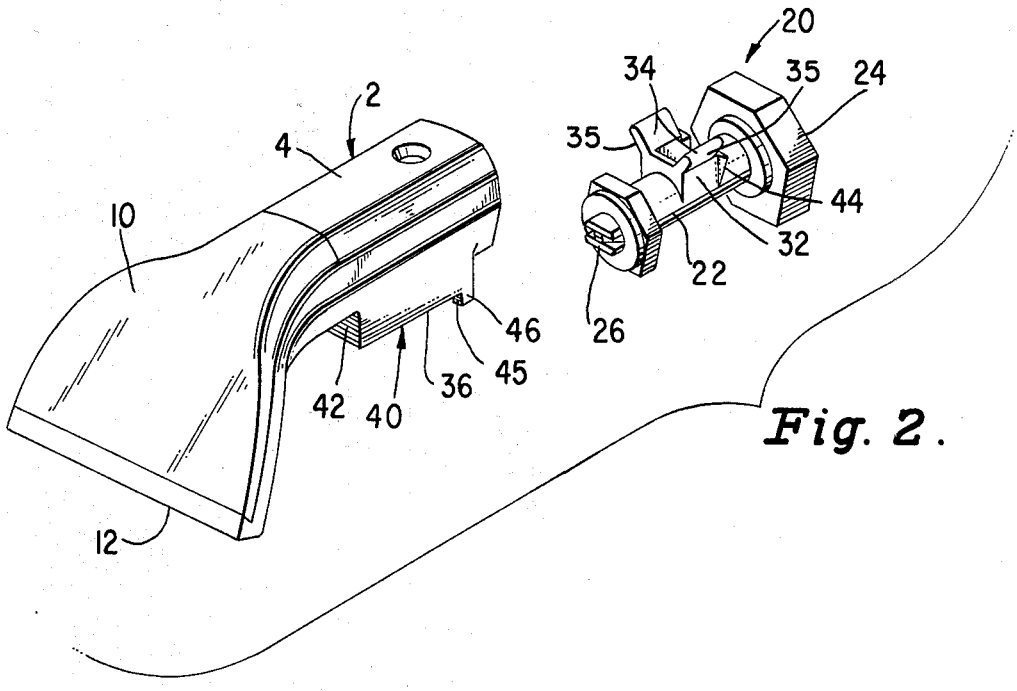
FIG. 2 is a perspective view showing the cleaning fluid dispenser disconnected from the nozzle body.

Referring to FIGS. 1 through 5 there is shown a surface cleaning vacuum nozzle having a body 2, a vacuum inlet port 4 having an inside diameter adapted to slidingly engage the outside diameter 6 of the hand held wand 8 which is connected to a suction source. The body 2 is held in engagement with the wand 8 by a spring biased latch 5 that is well known by those skilled in the art. The nozzle body 2 has a curved portion 10 terminating in an elongated intake orifice 12. The orifice 12 is in vacuum communication with the wand 8. A cleaning fluid dispenser 20, as shown in FIG. 3, comprising a manifold 22, a fluid seat 23, a captive nut 24, and a spray head 26, is slidingly supported on the body 2. The fluid seat 23 and nut 24 are positioned on one end of the manifold 22 and are adapted to engage a threaded outlet 25 which is formed integral to a cleaning fluid valve 27 for providing a fluid seal between the manifold 22 and the outlet 25. The cleaning fluid valve 27 is rigidly attached to the hand held wand 8 and includes a housing 28 having a hollow interior, an outwardly spring biased valve seat 30, and a finger operated trigger 31 for moving the valve seat 30 inwardly in opposition to the spring bias. A cleaning fluid supply tube 29 is connected to the housing 28 so that cleaning fluid may be introduced into the interior. In operation, the valve seat 30 is urged into sealing engagement with the fluid seat 23 of the dispenser 20. As the trigger 31 is actuated, the valve seat 30 is moved away from the fluid seat 23 permitting cleaning fluid to flow from the supply tube 29 into the dispenser 20. This type of valve is well known in the art and is offered as an example only. Other similar valves will function equally as well.

As shown in FIGS. 4 and 5 the manifold 22 has two parallel support legs 32 each terminating in an outturned projection 34 form flaired surfaces 35. These outturned projections 34, are adapted to slidingly engage the slot, or dovetail 40 of the body 2. The slot, or dovetail 40 is formed with two converging rail members 36 having side surfaces 37 which closely embrace the outer surfaces 35 of the projections 34 thereby forming a dovetail-like joint. The side surface 37 of the rails 36 together with the flat surfaces 38 form the dovetail 40. Upon reviewing this disclosure it will become apparent to one skilled in the art that variations in the shape of the projections 34 and slot 40 which result in dovetail, dovetail-like, or partial dovetail interlocking, but sliding, surfaces will function as well as the structure described above. Such variations are contemplated to be within the spirit and scope of this invention. An end piece 42 formed transversely to the rails 36 is arranged to limit sliding motion of the manifold 22 in the direction of the orifice 12 by providing an abutting surface for the support legs 32. At its opposite end each of the legs 32 has an outturned deformable tab 44 which projects over its respective rail 36. As shown in FIG. 5, the tabs 44 are completely clear of the dovetail 40. There are two lugs 46 formed adjacent and orthogonal to the end of the rails 36 opposite the end piece 42. The lugs 46 are completely clear of the dovetail 40 and are arranged to provide abutting surfaces 45 for the deformable tabs 44 and thereby limiting the sliding motion of the manifold 22 in the direction of the wand 8.

The deformable tabs 44 and lugs 46 have formed thereon angled surfaces for aiding initial assembly of the dispenser 20 to the body 2 during the manufacturing of the upholstery cleaning nozzle. It is intended that this initial assembly be performed only once, at the factory, after which the dispenser 20 will remain assembled and captive to the body 2. The deformable tabs 44 have first angled surfaces 48 formed thereon for camming engagement with second angled surfaces 47 formed on the lugs 46. Each pair of angled surfaces 47, 48 are arranged so that when the projections 34 are fully inserted into the dovetail 40 the angled surfaces 47, 48 engage, resulting in a camming action that urges the deformable tabs 44 inward so that they pass the lugs 46. The tabs 44 are sufficiently elastic so that as they pass the lugs 46, the tabs snap outward to their original position and thereby hold the dispenser 20 captive to the body 2 as shown in FIGS. 4 and 4*a*. The dispenser 20, however, is free to slide longitudinally with respect to the body 2 within the limitations set by the end piece 42 and the lugs 46. The dispenser 20 with its integrally formed tabs 44 and lugs 46 may be constructed of most materials, such as plastic for example, having reasonable rigidity and being sufficiently elastic to permit deformation and restoration of the tabs 44 as described above.

With this arrangement the surface cleaning nozzle may be easily connected to the wand 8 by inserting the outer diameter 6 of the wand 8 into the vacuum inlet port 4 of the body 2 until the latch 5 engages, sliding the dispenser 20 rearward until engagement is made with the valve 27, then assembling the captive nut 24 onto the threaded outlet 25 and tightening to form a fluid seal. When it is desired to disconnect the surface cleaning nozzle from the wand 8 the captive nut 24 is first completely loosened then the latch 5 depressed and the body 2 removed from the wand.

Upon reviewing the present disclosure, a number of alternative constructions embodying the principles of this invention will occur to one skilled in the art. Such constructions may involve a slot 40 of a shape different to that of a dovetail or the lugs 46 may project radially outward or in another suitable direction. Such other constructions embodying these principles are deemed to be within the scope and spirit of this disclosure. It is to be understood that the preferred embodiment described herein is for purposes of illustration only and not to be construed as a limitation of this invention.

What is claimed is:

1. A surface cleaning vacuum nozzle or the like having: a rigid body of hollow interior adapted for connection to a suction source; an orifice in vacuum communication with said interior for engaging the surface and removing loose dirt or the like therefrom; a cleaning materials dispenser adapted to be connected to a cleaning material supply for applying said cleaning material to the surface in close proximity to said orifice; and attachment means for slidingly attaching said dispenser to said body, said attaching means comprising:

a. a projection formed on one of said body and said dispenser; and b. a slot formed on the other of said body and said dispenser so that said projection is constrained within said slot to slide in a longitudinal direction with respect to said nozzle wherein said slot and said projection include means for holding said projection captive within said slot comprising:

a. a lug formed adjacent to one end of and at right angles to said slot; and b. a deformable tab formed adjacent to one end of said projection such that when said projection is in sliding engagement with said slot, said deformable tab abuts said lug to limit relative sliding movement between said projection and said slot.

2. A surface cleaning vacuum nozzle as set forth in claim 1 wherein said deformable tab is sufficiently elastic so as to be deformed out of abutting contact with said lug and when released will assume its original position of said abutting contact.

3. A surface cleaning vacuum nozzle as set forth in claim 2 wherein said deformable tab and said lug each having an angled surface, said angled surfaces being formed such that when said dispenser is being assembled to said body said angled surfaces will engage whereby said deformable tab will be urged by camming action out of abutting contact with said lug.

4. An upholstery cleaning nozzle having: a rigid body of hollow interior adapted for connection to a suction source, said body having an intake orifice in vacuum communication with said interior for engaging upholstery and removing dirt and debris therefrom; a spray head assembly having a cleaning fluid connector means for attachment to a cleaning fluid source, and a dispensing spray member in fluid communication with said cleaning fluid connector means for applying the cleaning fluid to upholstery; and attachment means for slidingly attaching said spray head assembly to said body comprising:

a. a dovetail-like shaped slot formed in said body;

b. a dovetail-like shaped projection formed in said spray head assembly adapted for sliding engagement with said dovetail-like shaped slot and constrained to slide in a longitudinal direction with respect to said upholstery cleaning nozzle;

c. means for holding said projection captive within said slot comprising: a lug formed adjacent to one end of and at right angles to said slot and a deformable tab formed adjacent to one end of said projection so that when said projection and said slot are assembled said deformable tab abuts said lug to limit relative sliding movement between said projection and said slot wherein both said lug and said tab each have an angled surface, said angled surfaces being formed so that when said spray head assembly is being assembled to said body said angled surfaces will engage and said deformable tab will be urged by camming action out of abutting contact with said lug until said projection has sufficiently slidingly engaged said slot and said deformable tab being sufficiently elastic will assume its assembled position of said abutting contact.

5. An upholstery cleaning nozzle adapted for use in conjunction with a hot water extraction carpet cleaning system or the like, said cleaning nozzle having:

a. a body having a suction port formed in one end thereof and an intake orifice formed in another end thereof, said intake orifice being in vacuum communication with said suction port for engaging upholstery and removing dirt and debris therefrom;

b. a spray head assembly having a cleaning fluid connector portion for attachment to a cleaning fluid source wherein said spray head assembly is in fluid communication with said fluid source for dispensing cleaning fluid on the upholstery in proximity to said intake orifice; and c. attachment means for slidingly attaching said spray head assembly to said body so that said suction port may be connected to said suction source independent of and prior to connecting said cleaning fluid connector portion to said cleaning fluid source, wherein said attachment means comprises:

a slot formed in said body, said slot having two spaced apart side surfaces converging in a direction away from said body;

a projection formed in said spray head assembly and adapted for sliding engagement with said slot, said projection having a flared surface arranged for interlocking engagement with one of said side surfaces.

6. An upholstery cleaning nozzle as set forth in claim 5 wherein said projection is constrained within said slot to slide in a longitudinal direction with respect to said upholstery cleaning nozzle.

7. An upholstery cleaning nozzle as set forth in claim 6 wherein said projection and said slot form dovetail-like mating surfaces.

8. An upholstery cleaning nozzle as set forth in claim 6 wherein said means for holding said spray head assembly captive to said body comprises: a lug formed adjacent to one end of and at right angles to said slot and a deformable tab formed adjacent to one end of said projection so that when said projection and said slot are in sliding engagement said deformable tab abuts said lug to limit relative sliding movement between said projection and said slot.

9. An upholstery cleaning nozzle as set forth in claim 8 wherein said deformable tab is sufficiently elastic so that it may be deformed out of abutting contact with said lug and when released will return to its original position of abutting contact.

10. An upholstery cleaning nozzle as set forth in claim 9 wherein said deformable tab and said lug each have an angled surface, said angled surfaces being formed so that when said spray head assembly is being assembled to said body said angled surfaces will engage and said deformable tab will be urged by camming action out of abutting contact with said lug until said projection has sufficiently slidingly engaged said slot and said deformable tab being sufficiently elastic will assume its assembled position of said abutting contact.

* * * * *